United States Patent [19]

Mampaey et al.

[11] Patent Number: 4,843,422

[45] Date of Patent: Jun. 27, 1989

[54] ELECTROPHOTOGRAPHIC APPARATUS

[75] Inventors: Jozef L. Mampaey, Kontich; Lucien P. Van der Vliet, Hoboken, both of Belgium

[73] Assignee: Agfa-Gevaert N.V., Mortsel, Belgium

[21] Appl. No.: 498,159

[22] Filed: May 25, 1983

[30] Foreign Application Priority Data

May 26, 1982 [GB] United Kingdom ..... 8215315

[51] Int. Cl.[4] ..... G03G 15/00

[52] U.S. Cl. ..... 250/326; 355/221; 250/324; 250/325

[58] Field of Search ..... 355/3 CH, 14 E, 14 CH; 250/324, 325, 326; 174/127; 361/229, 230, 213; 474/253, 254, 255, 256, 257, 258, 260

[56] References Cited

U.S. PATENT DOCUMENTS

| | | | |
|---|---|---|---|
| 367,041 | 7/1887 | Heywood | 474/253 |
| 371,057 | 10/1887 | Gleadall | 474/255 |
| 377,937 | 2/1888 | Heywood | 474/253 |
| 2,856,533 | 10/1958 | Rosenthal | 250/325 |
| 3,105,390 | 10/1963 | Funke et al. | 474/254 X |
| 3,840,744 | 10/1974 | Hedman, Jr. | 250/324 |
| 3,965,400 | 6/1976 | Tolliver | 250/324 X |
| 4,140,412 | 2/1979 | Vitt | 474/255 X |
| 4,442,356 | 4/1984 | Ludwich et al. | 361/230 X |

FOREIGN PATENT DOCUMENTS

| | | | |
|---|---|---|---|
| 0080779 | 6/1934 | Sweden | 474/253 |

*Primary Examiner*—William M. Shoop, Jr.
*Assistant Examiner*—Paul Ip
*Attorney, Agent, or Firm*—William J. Daniel

[57] ABSTRACT

Electrophotographic apparatus incorporating a corona discharge station with corona discharge from a wire. The corona wire extends as a continuous loop between two pulleys and is advanced at a velocity in excess of the velocity of the photoconductor to be charged. The ends of the wire from which the loop is made are tied together by means of a knot, and the knot is embedded in a bead of an elastic material, preferably polyurethane.

9 Claims, 3 Drawing Sheets

ELECTROPHOTOGRAPHIC APPARATUS

Figure 1:
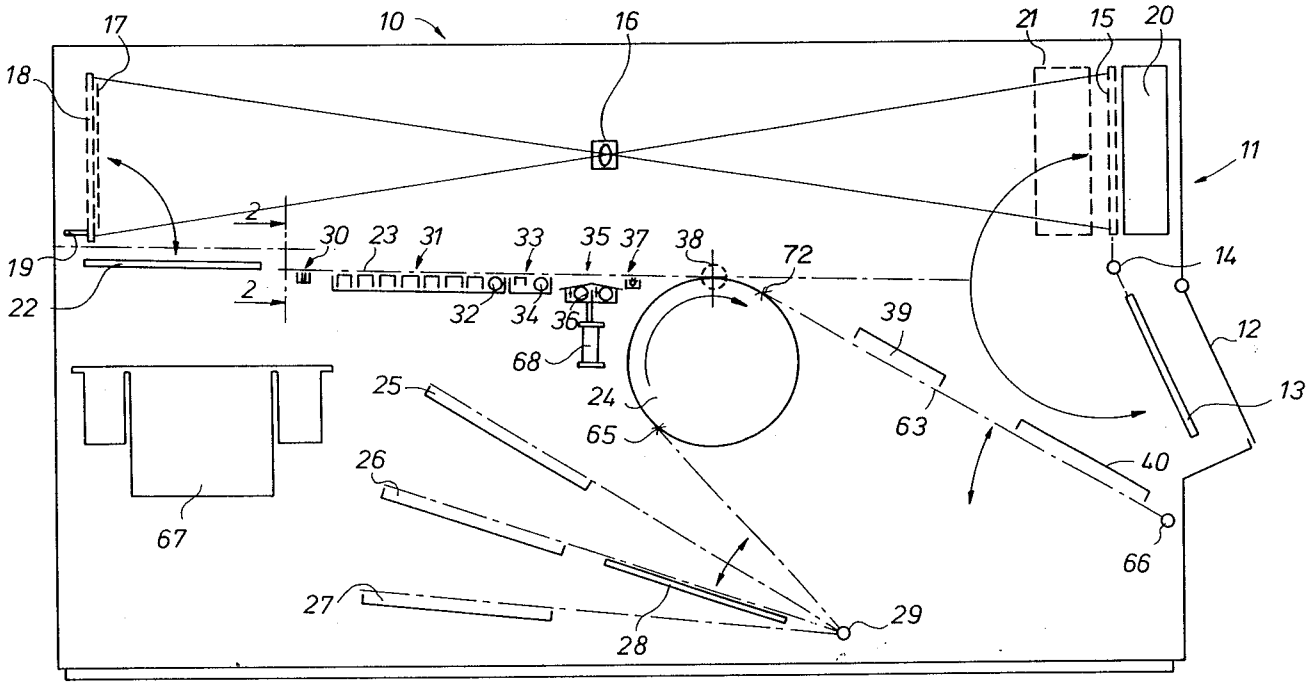

This invention relates to apparatus for use in electrostatically charging the surface of a dielectric element. The invention is applicable for example in electrophotographic apparatus for electrostatically charging the surface of a photoconductive element as a step in the production of an electrophotographic latent image.

In electrophotography, it is common to form an electrostatic latent image by overall electrically charging the surface of a photoconductive insulating layer and selectively dissipating charges from the surface by exposing the charged surface to the image to be reproduced. The areas to be exposed may be exposed simultaneously or increments thereof can be exposed successively by a section-wise or linewise scanning exposure system. Known exposure systems include laser scanning, and exposure to lines of individually addressable point-like radiation sources such as light-emitting diodes (LEDs). The photoconductive layer may be carried by a flexible or rigid support, either flat or curved, e.g. a support in sheet form or in the form of a drum.

In an alternative procedure for forming an electrophotographic latent image, a photoconductive layer is exposed to overall uniform charging conditions following image-wise exposure, thereby relying on a light image memory property of the photoconductive layer. As another alternative, initial overall positive charging and image-wise exposure of the photoconductive can be followed by uniform deposition of negative charges of an opposite polarity and of a magnitude such as to convert the initial positive latent image to a negative latent image.

The electrostatic charging of a dielectric element is also useful for forming electrostatic latent images on non-photoconductive insulating materials by image-wise exposing the dielectric element to charging conditions.

Following formation of an electrostatic latent image, the image can be developed by bringing it into contact with an oppositely charged toner e.g. with toner particles in dry form or dispersed in a liquid. The toner image can then be fixed on the dielectric element or transferred to another support, e.g. a white support such as a sheet of white paper, or onto another form of support such as a printing plate blank.

It is well known to effect electrostatic charging of a dielectric element by means of a corona discharge. For this purpose use is commonly made of a corona discharge wire which is stretched transversely across and at a suitable spacing from a path along which the dielectric element is conveyed.

It is important to be able to deposit a uniform electric charge on a given dielectric surface in order that the latent image resulting from charging and exposure shall be developable to a good quality graphic reproduction. Uniform charging of a dielectric by means of a corona discharge is much easier to achieve in the case of positive charging than in the case of negative charging. Positive corona discharge from a wire generally occurs substantially uniformly along and around the wire, forming as it were a continuous uniform sheath around the wire. A positive corona discharge is commonly employed for example for charging photoconductors such as Se and $As_2Se_3$. When however it is required to deposit a negative charge, as is required for example when charging a photoconductive element composed of ZnO for CdS it is not satisfactory to use a straight corona wire stretched across the path of the photoconductive element because a negative corona has a tendency to concentrate itself at discrete points along the wire with the result that the negative charge deposits on the dielectric surface in a non-uniform pattern corresponding to the non-uniformity of the corona discharge itself.

With a view to solving this problem, U.S. Pat. No. 2,856,533 discloses an electrostatic charging apparatus comprising a corona wire which is displaced during use so as to average out non-uniformity of corona emission from the wire. The motion imparted to the wire can be for example be a linear reciprocating motion or a rotary motion around the longitudinal axis of the wire. For the reasons explained, such an apparatus is of particular value for effecting negative charging, but it can also be used for generating a positive corona discharge.

One apparatus described in the above U.S. patent utilises a corona wire forming a continuous loop which is supported by reversing pulleys and the wire is advanced along its endless course during use. This proposal is of particular interest. Such a loop can be rotated at a relatively high speed, which implies that a uniform charging of the dielectric element can be achieved even when that element is displaced past the corona wire at a relatively high speed. For example, the loop can be rotated at a speed such that it makes at least one revolution in the time it takes any increment of the dielectric surface to move through the corona discharge field. In these circumstances every point on the dielectric surface will receive an incrment of charge proportional to the average corona emission along the wire.

A difficulty which has been encountered in putting the foregoing looped wire proposal into practice is that of making an effective and reliable joint between the ends of the wire. By way of example, an appropriate wire may have a diameter between 20 and 100 micrometers and may be required to be run at a speed of several meters per second. During use, considerable stress is put on the joint between the wire ends and the stress will tend to be greater the smaller is the diameter of the reversing pulleys. For space economy and other reasons, small pulleys are to be preferred, e.g. pulleys with a diameter down to about 20 mm.

Experiments have been made with wire loops formed by welding the wire ends together. These experiments showed the joints to be unsatisfactory. The operating life of the loops was very short. Conventional spot welding, butt welding, and laser welding techniques all apparently seriously affected the crystalline structure of the wire in the immediate vicinity of the weld, so that after a period of operation ranging from a few to some tens of hours, the wire ruptured at a location adjacent the joint.

It is an object of the present invention to provide an electrostatic charging apparatus with a corona discharge loop of greater durability.

There is provided according to the present invention an apparatus as defined in claim 1 hereof. Such apparatus is characterised in that the loop of corona discharge wire has been formed by tying together the ends of one or more lengths of wire and in that the or each tying knot is embedded in an elastically deformable bead which extend onto wire portions adjacent the opposite ends of the knot, said bead having a resistance to elastic deformation such that the bending of the wire at said opposite ends of the knot during its passage around the pulleys is less sharp that it would be in the absence of the bead.

It is obviously simplest to use a single length of wire and in the following description the use of such a single wire will be assumed.

By knotting the ends of the wire and embedding the knot in a bead having the specified characteristics a loop can be formed which, under given operating conditions, has a much longer operating life than the otherwise jointed wires above referred to.

Experiments have shown that a role of the bead is very important. In the absence of the bead wire failure occurs very much sooner. It is believed that this early failure is caused by localised bending of the wire at the points of entrance to the knot, coupled with changes of the bending direction which can occur because the wire is free to rotate about is longitudinal axis during the rotation of the loop. This invention makes the attainment of a longer operating life compatible with the use of pulleys of small diameter, e.g. less than 50 mm in diameter.

The invention includes electrostatic charging apparatus incorporating a loop of corona discharge wire which has been formed by tying together the ends of at least one length of wire and embedding the or each tying knot in an electric bead which extends onto wire portions adjacent the opposite ends of the knot and which is composed of a material having an elasticity modulus smaller than that of the wire. Such a bead is effective for distributing bending stresses in the regions of the knot ends and thereby contributes to the durability of the loop under operating conditions.

As will hereafter be exemplified, a corona wire loop according to the invention can have an operating life running into hundreds of hours, which is far in excess of the useful life of loops formed by previously proposed methods.

Preferably the thickest region of the bead coincides with and is of substantially the same cross-sectional dimensions as the thickest region of the knot. This condition is recommended because it is preferably for the disparity in cross-sectional size between the central region of the bead and its end portions to be no greater than necessary.

For convenience and effectiveness the bead is preferably formed of a synthetic polymeric material, most preferably a synthetic elastomeric material, e.g. polyurethane rubber.

The bead can be formed by working unpolymerised material into and around the knot, e.g. with the fingers, and polymerising the material in situ.

In preferred embodiments, the knot is a granny knot. Experiments have shown that this type of knot gives better results than are obtainable with other knots, such as a reef knot.

The loop can be driven by a single pulley, the or each other pulley being an idler pulley.

The pulleys around which the corona wire travels can be made of or lined with resilient material to afford a cushioning effect which can further prolong the useful life of the wire.

If the corona loop is rotated only when a dielectric element is passed through the electrostatic charging station, in other words if the loop is rotated intermittently, it is preferably to avoid any significant slippage of the corona wire on its pulleys. The energising circuit of the loop driving means should therefore preferably cause smooth acceleration and declaration of the loop at the commencement and termination of its rotation.

The invention can be employed with advantage to a positive charing corona but for reasons hereinbefore given the benefits of the invention are particularly marked as applied to a corona wire producing a negative corona discharge.

Figure 2:
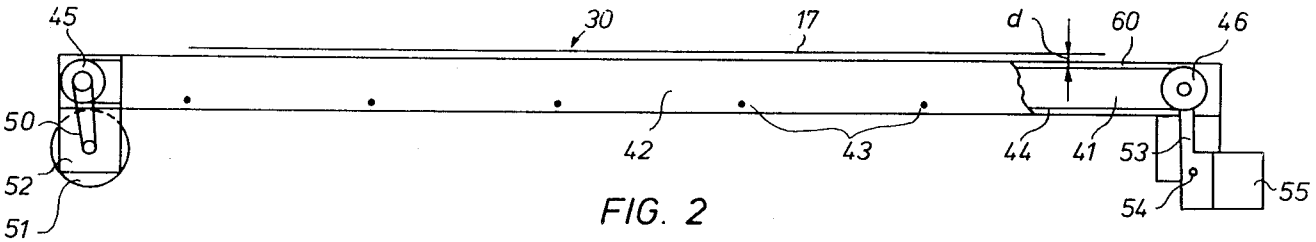
Figure 3:
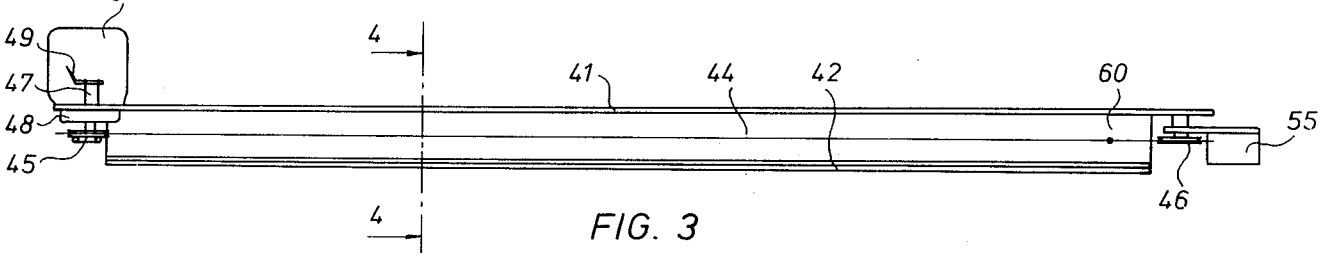
Figure 6:
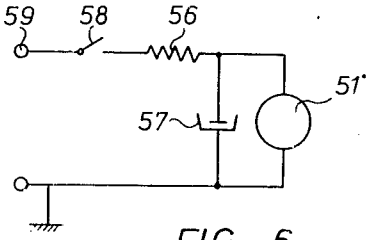
Figure 4:
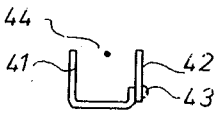
Figure 5:
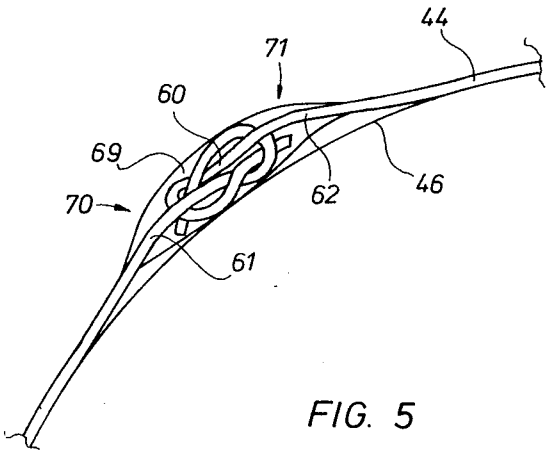

An embodiment of the invention, selected by way of example, will now be described with reference to the accompanying diagrammatic drawings, in which:

FIG. 1 is a diagrammatic longitudinal sectional view of an electrophotographic apparatus wherein a corona discharge wire in the form of a continuous loop is used, FIG. 2 is a view of the corona discharge device, on line 2—2 of FIG. 1, FIG. 3 is a top view of the corona discharge device, FIG. 4 is a transverse section on line 4—4 of FIG. 3, FIG. 5 is a view of a knot with an embedding bead, in course of travelling around a pulley, and FIG. 6 is an electric circuit for the smooth starting of the driving motor of the corona unit.

Referring to FIG. 1 which shows a diagrammatic illustration of a lithographic platemaker for making lithographic printing plates from a paste-up, the apparatus is mounted within an elongated light-tight housing 10 that is provided at its frontside 11 with a rectangular, light-tightly closable panel 12 that permits to an operator to fit a paste-up to be reproduced onto a pivotable transparent holder 13. The holder 13 is preferably fitted with an underpressure system, so that by atmospheric pressure the paste-up may be urged into intimate contact with the flat supporting board of the holder. The holder may be swung about a horizontal pivot axis 14 into a vertical position 15 illustrated in broken lines. In that position the location of the paste-up is at the left-hand side of the holder according to the drawing, and the image of the paste-up may be projected by a lens 16 onto a reusable photoconductor sheet 17 that is fitted to a sheet holder 18. The sheet 17 and the holder 18 have been illustrated in broken lines in the vertical position since they are pivotable about a pivot axis 19 into an almost horizontal position wherein the processing and the transfer of the toner image occur.

The lighting of a paste-up may occur by means of a lamp boxes such as 20 and 21. The lamp box 21 is arranged for pivotation out of the path of holder 13, in order to enable the movements of the holder between its upper and lower position.

The photoconductor holder 18 forms part of a carriage 22 to which the holder is pivoted. When the holder has been lowered onto the carriage, the carriage is moved along the substantially horizontal path indicated by the dash and dot line 23 that runs tangentially to a cylindrically curved sheet supporting member 24 onto which a receptor sheet in the form of an uncoated anodized aluminium plate may be fitted.

A suitable embodiment of the carriage and its photoconductor holder is disclosed in our co-pending Application entitled : "Apparatus for transferring electrophotographic images", filed on even day herewith.

A suitable embodiment of the mounting of the photoconductor sheet to the photoconductor holder is disclosed in our co-pending Application entitled : "Apparatus and process for transferring xerographic images", filed on even day herewith.

Aluminium plates of different formats are stored in bins such as 25, 26 and 27, and a plate transfer mechanism 28 that is pivotable at 29, is arranged to transport the desired plate to the member 24. In case of smaller plate formats, the plates may be loaded in a bin as pairs of plates, and they may be fed to the drum in side by side relationship. A suitable device for gripping and lifting the plates in the mechanism 28 is disclosed in our co-pending Application entitled : "An object holding device of sucker-cup type and sheet dispensing apparatus incorporating such device", filed on even day herewith.

The member 24, called hereinafter drum for the sake of simplicity is provided with means for receiving a plate or plates and for clamping it or them in a well-determined position on the periphery of the drum. A suitable construction for the drum that is capable of receiving different sheet formats and for tightly tensioning them on the drum, is disclosed in our co-pending European Application No. 83 200 310.7, filed Mar. 4, 1983.

The following processing stations are provided for hte photoconductor sheet 17.

A corona discharge station 30 for the uniform charging of the photoconductor during its return movement which follows image transfer and is prior to the image-wise exposure.

A liquid toner developing station 31 wherein the electrostatic charge pattern that remains after the image-wise exposure, is developed, and wherein a reversely rotating roller 32 controls the thickness of the layer of remaining developing liquid. A suitable developing device for the present application is disclosed in our co-pending European Application No. 83 200 070.7 filed at the Jan. 19, 1983.

A rinsing station 33 wherein the photoconductor surface is rinsed with a toner-free liquid, such as isododecane, thereby to clear the background of the image, and wherein a reversely rotating roller 34 controls the thickness of the remaining rinsing liquid layer.

A cleaning station 35 with rotatable resilient cleaning rollers 36 and scraper blades for cleaning the photoconductor during its returning movement. The station may be vertically raised over some centimeters, by means of a mechanism represented diagrammatically by cylinder 68, thereby to be operative only during the return movement of the carriage.

A reconditioning station 37 wherein a flooding with light prepares the photoconductor during its return movement for the next imaging cycle.

A toner transfer station, indicated by a circle 38 in broken lines, wherein by the appication of a suitable potential difference between the photoconductor and the aluminium receptor plate on the drum 24, the developer toner pattern is progressively transferred onto the aluminium plate during the movement of the photoconductor past such plate.

A drying station 39 and a fixing station 40 for treating the aluminium plate after it has been removed from the drum 24, and transferred to the outlet of the apparatus. The fixing station 40 may be arranged for pivotation at 66, so that it may be swung into a horizontal position preparatory at the discharging of the aluminium plate from the apparatus.

It will be understood that the apparatus comprises a plurality of other facilities such as electrical and electronic control means, liquid supply means as diagrammatically illustrated by the numeral 67 pumps, filters, safety dispositions, etc. All these facilities belong to the state of the art and they require no further description hereinafter.

Referring to FIGS. 2, 3 and 4, the corona discharge device is mounted on an L-shaped metal beam 41 to which a metal plate 42 is fitted by means of screws 43 or the like permitting the plate to be easily removed for giving ready access to the corona wire. The corona wire is in the form of an endless loop 44 running over two pulleys 45 and 46. The pulley 45 is the driving pulley, made of an electrically conductive material such as aluminium, and is mounted for free rotation on a stationary pin 47 that is electrically insulated from the beam 41 by means of a plastic mounting base 48. A lug 49 on the pin permits the connection of a D.C. high tension supply to the pulley. The pulley is provided with two grooves, one for the corona wire loop 44, and the other for the driving belt 50, made of an electrically insulating material such as rubber or the like. The driving motor 51 may be a small D.C. motor mounted on a rectangular plate 52 welded to the beam 41.

The pulley 46 is made of an electrically insulating material such as polyvinylchloride, and is mounted for free rotation on a pin at the free extremity of one arm 53 of a lever that is pivotable about a pin 54 mounted on a downward extension of the beam 41. The other arm of the lever carries a counterweight 55 by which the wire loop is tensioned. The endless loop 44 of wire has been made by cutting a length of wire from a roll, and tying the ends together by means of a granny knot 60. The knot was embedded in polyurethane rubber by forming a small droplet of rubber at the pointed extremity of a rod having a thickness of some millimeters, and then smearing out the compound around and working it into the knot by means of the pointed rod.

As shown in FIG. 5 the polyurethane rubber forms a bead 69 which extends onto and adheres to wire portions 61, 62 adjacent the opposite ends 70, 71 of the knot. The maximum outside diameter of the bead is substantially the same as that of the knot.

The energizing of the D.C. motor 51 may occur through a circuit comprising a resistor 56 and a capacitor 57 as illustrated in FIG. 5, so that closing of a switch such as 58 causes a D.C.-supply potential at the terminal 59 to become only progressively applied to the motor 51, so that the time required for the motor to obtain its normal speed takes some seconds. In the absence of a delaying circuit, closing of the switch 58 would cause the motor to obtain its rated speed within about 300 msec so that inevitably some slipping would occur between the wire and the pulley reducing the lifetime of the wire loop.

Disconnection of the motor from the supply circuit requires no particular measures, because the momentum of the rotor of the motor and of the pulley 45 usually ensure a sufficiently slow deceleration to avoid any significant slippage.

The mounting of the corona discharge device at station 30 is such that the upper stretch of the wire loop is separated from the plane wherein the downwardly facing surface of the photoconductor sheet 17 moves, over a distance of some centimeters, see the separation indicated by d in FIG. 2. The direction in which the wire moves is at 90 degrees with respect to the direction of movement of the photoconductor sheet.

The operation of the disclosed apparatus is as follows. The carriage 22 being in a rest position that may be situated approximately over the cleaning station 35, the driving means for the carriage is actuated to drive the carriage in the left-hand direction, according to FIG. 1, until the carriage has reached the position illustrated in FIG. 1. Corona discharge station 30 uniformly sprays the photoconductor sheet 17 with negative charges during the passage of the sheet through the station. When the carriage has reached its end position, the holder 18 is swung in the position indicated in broken lines and the photoconductor is image-wise exposed whereby surface charges at the light image parts are removed. After the exposure, the holder is lowered into its horizontal position, and the driving means is reversed to drive the carriage at a uniform speed through the successive processing stations. In the developing station 31, the electrostatic charge pattern of the photoconductor is developed by the contact with the liquid toner at the top of the developing station. The layer thickness of the liquid on the photoconductor is reduced to some tens of micrometers by the reversely rotating thickness control roller 32. The developed charge image is rinsed in the rinsing station 33, and finally the photoconductor sheet reaches the transfer zone 38 with a layer of toner liquid, approximately ten micrometers thick, adhering to the photoconductor.

During the continued advance of the photoconductor sheet over the drum 24 which carries an aluminium plate, the drum is rotated at a peripheral speed equal to the linear speed of the sheet 17 and a suitable D.C. potential difference is maintained between the photoconductor sheet 17 and the drum 24 which causes the progressive image-wise transfer of toner onto the plate.

After the drum 24 has rotated through approximately 390 angular degrees, the grippers on the drum that hold the leading edge of the aluminium plate are released and this edge separates from the drum at the position marked 72. As the drum continues to rotate the plate is advanced along a path 63 and by means (not shown) the plate is transported past the drying station 39 where the developer liquid is evaporated, and a fixing station 40 where the toner image is fused into the printing surface of the aluminium plate. The plate is then ready for removal from the apparatus and for an occasional treatment with a liquid lithographic preparation containing a compound enhancing the ink and/or lacquer receptivity of the toner image, and containing further a compound increasing the ink-repelling characteristics of the plate metal. After the plate has left the drum 24, the drum continues to rotate until at a plate loading position, indicated at 65, the leading edge of a new plate or new plates as the case may be, is or are fed by the mechanism 28 to the drum. During further rotation of the drum to accept a new plate, the carriage with the photoconductor is returned to its position towards the left-hand side of FIG. 1. During said returning movement, the light source 37 is energized to uniformly expose the photoconductor, and the cleaning station 35 is made operative by its raising by the cylinder 68, thereby to contact the photoconductor during its returning motion and flush away any remnant toner particles.

The following data relates to an apparatus as above described with reference to the drawings:

size of photoconductor sheet: 915×635 mm
composition of photoconductor sheet 17:
a polymeric support provided with an electrically conductive layer and a layer of anorganic photoconductor
aluminium plate formats: up to 925×635 mm
speed of photoconductor during the charging by the corona discharge device 30: 30 $cm.sec^{-1}$
speed of corona wire loop: 8 $m.sec^{-1}$
voltage of corona wire: 9 KV
voltage of housing of corona wire: zero (grounded)
voltage of photoconductor conductive layer: zero (grounded)
corona wire: massive tungsten wire with a diameter of 60 microns
diameter of knot and bead=200 microns
length of bead: approximately 1 mm
tension of wire: $2.10^8$ $N.m^{-2}$
type of material for producing the bead 60: one component polyurethane rubber, manufactured by Goodrich-Ciag, tradename Estane, type 5712 F50
diameter of pulleys 45 and 46: 40 mm
spacing d between wire and photoconductor: 25 mm
lifetime of the corona wire: greater than 650 Hrs of operation.

The uniformity of charging was examined by examination of the images densities on the developed printing plate. To this end an overall black image with an optical density of 1, measured in reflection, was produced, and this image was examined for density variations greater than 0.01. Variations of this order of magnitude are recognizable by a skilled operator. It was found that there were no variations greater than 0.01 and this is considered as an excellent result for a lithographic printing plate.

The invention is not limited to the described embodiment. The corona discharge device may be arranged in such a way that both stretches of the wire loop are operative in the charging of the photoconductor.

The wire may be conveyed over more than two pulleys and its tensioning may be performed by spring means.

The tying together of both wire ends to form a closed loop may occur by other knots, such as square (reef) knot, a weaver's knot, etc.

Suitable materials for embedding the knot include natural as well as synthetic one or two-component compounds having the requisite properties for distributing bending stresses which would otherwise be localised or more localised at the ends of the knot. The selected material should have a sufficient resistance to aging under the influence of ozone created during the corona discharge, and a sufficient resistance against fatigue and wear caused by the repeated passages of the wire over the pulleys.

Examples of other materials than the disclosed example are epoxy resins, polyurethane rubbers, silicone rubbers, etc. Good results have been obtained with a knot embedded with Devcon, Flexane type 30 putty resin, composed of 2 parts of resin and 2.5 parts of harder.

The members 41 and 42 of the corona unit in FIG. 4 may be connected to an electric potential rather then being electrically grounded. The same applies to the photoconductor 17.

The mentioned members may have other forms, and may even be omitted, since charging by corona discharge is possible also without such members.

The device may be used in other types of electrophotographic apparatus, e.g. apparatus wherein transfer images are made on plain paper rather than a printing plate, wherein a non-resuable photoconductor is used, wherein the photoconductor is provided on a drum, either in the form of a separate sheet, or as a layer coated on a metal cylinder, etc.

We claim:

1. Apparatus for use in electrostatically charging the surface of a dielectric element, comprising a corona discharge monofilament wire in the form of a continuous loop running over pulleys, the arc of contact of said wire with each said pulley not exceeding about 180°, means for advancing the wire in one direction along its loop-shaped path, means for connecting said wire to a corona-generating voltage source, and means for causing relative bodily movement between said corona wire and said dielectric element so that said element surface becomes swept by corona discharge from said wire, said loop being formed by knotting together the ends of at least one length of said monofilament wire and each such knot being embedded in an elastically deformable bead which extends onto wire sections on opposite sides of the knot, said bead having a resistance to elastic deformation such as to reduce the sharpness of the bending of the wire on said opposite sides of such knot during its passage around said pulleys, said bead tapering gradually continuously in thickness at both ends thereof, said wire loop advancing means comprising driving means for driving said wire loop via a pulley, said driving means having an energizing circuit causing smooth acceleration and deceleration of said loop at the commencement and termination of its advancement.

2. Apparatus according to claim 1, wherein a said bead has a thickest region which coincides with and is of substantially the same cross-sectional dimensions as the thickest region of said knot.

3. Apparatus according to claim 1, wherein the material of the or each said bead is a synthetic polymer material.

4. Apparatus according to claim 1, wherein the material of the or each said bead is a synthetic elastomer.

5. Apparatus according to claim 1, wherein said material is a polyurethane rubber.

6. Apparatus according to claim 1, wherein each said knot is a granny knot.

7. Apparatus according to claim 1, wherein said loop is connected to a corona-generating voltage source which causes said loop to be negatively charged.

8. Electrophotographic apparatus for forming toner images on a photoconductive element, said apparatus comprising means for applying electrostatic charges to the surface of said element, means for imagewise exposing siad element, and means for applying toner to develop a charge pattern resulting from the charging and exposure of said element; said charging means including a corona discharge monofilament wire in the form of a continuous loop running over pulleys, the arc of contact with said wire with each said pulley not exceeding about 180°, means for advancing said wire in one direction along its loop-shaped path, means for connecting said wire to a corona-generating voltage source, and means for causing relative bodily motion between said wire loop and said photoconductive element to cause said element to be swept by corona discharge from said wire, said continuous loop being formed by knotting together the ends of at least one length of wire and each such knot embedded in an elastic bead which extends onto wire sections adjacent the opposite sides of the knot and is composed of material having an elastic modulus that is smaller than that of said wire, said bead tapering gradually continuously in thickness at both sides thereof.

9. Apparatus for use in electrostatically charging the surface of a dielectric element, comprising a corona discharge monofilament wire in the form of a continuous loop running over pulleys, the arc of contact of said wire with each said pulley not exceeding about 180°, means for advancing the wire in one direction along its loop-shaped path, means for connecting said wire to a corona-generating voltage source, and means for causing relative bodily movement between said corona wire and said dielectric element so that said element surface becomes swept by corona discharge from said wire, said loop being formed by knotting together the ends of at least one length of said monofilament wire and each such knot being embedded in an elastically deformable bead of a polyurethane rubber elastomer which extends onto wire sections on opposite sides of the knot, said bead having a resistance to elastic deformation such as to reduce the sharpness of the bending of the wire on said opposite sides of such knot during its passage around said pulleys, said bead tapering gradually continuously in thickness at both ends thereof.

* * * * *